United States Patent [19]

de la Lande de Calan

[11] 4,037,371

[45] July 26, 1977

[54] CONSTRUCTION OF BUILDINGS BY ASSEMBLING PREFABRICATED ELEMENTS

[76] Inventor: Yves Jean Olivier de la Lande de Calan, 25 Rue du Faubourg St.-Honore, Paris 8e, France

[21] Appl. No.: 603,091

[22] Filed: Aug. 8, 1975

[30] Foreign Application Priority Data

Aug. 12, 1974 France ..... 74.27862

[51] Int. Cl.[2] ..... E04H 1/02

[52] U.S. Cl. ..... 52/79.7; 52/236.1; 52/DIG. 10

[58] Field of Search ..... 52/80, 79, 81, 732, 52/DIG. 10, 237; 46/24; 35/72

[56] References Cited

U.S. PATENT DOCUMENTS

| | | | |
|---|---|---|---|
| 595,782 | 12/1897 | Morsell | 35/72 |
| 856,838 | 6/1907 | Bell et al. | 52/DIG. 10 |
| 2,839,841 | 6/1958 | Berry | 52/DIG. 10 |
| 3,061,977 | 11/1962 | Schmidt | 52/81 |
| 3,137,371 | 6/1964 | Nye | 52/81 |
| 3,230,673 | 1/1966 | Gersin | 52/79 |
| 3,645,535 | 2/1972 | Randolph | 52/DIG. 10 |
| 3,660,952 | 5/1972 | Wilson | 52/DIG. 10 |
| 3,785,096 | 1/1974 | Neuhardt | 52/237 X |

FOREIGN PATENT DOCUMENTS

| | | | |
|---|---|---|---|
| 1,226,372 | 7/1960 | France | 52/79 |
| 1,262,098 | 4/1961 | France | 52/80 |
| 944,770 | 4/1949 | France | 46/24 |
| 1,316,018 | 12/1962 | France | 35/72 |
| 601,533 | 8/1934 | Germany | 46/24 |
| 1,002,301 | 8/1965 | United Kingdom | 52/81 |

OTHER PUBLICATIONS

Mathematical Models, Cundy and Rollett, pp. 166, 167, May 16, 1968.

*Primary Examiner*—Leslie Braun
*Attorney, Agent, or Firm*—Diller, Brown, Ramik & Wight

[57] ABSTRACT

Construction of buildings by assembling prefabricated elements. The volumes constructed are the sum of elementary volumes resulting from the division of a right prism whose height is a dimension U which is taken as unit and whose base is an equilateral triangle whose sides are equal to 2 U, this division being made through a plane passing through one side of one of the bases and the apex of the other base in line with the apex opposite the said side.

6 Claims, 23 Drawing Figures

FIG.9
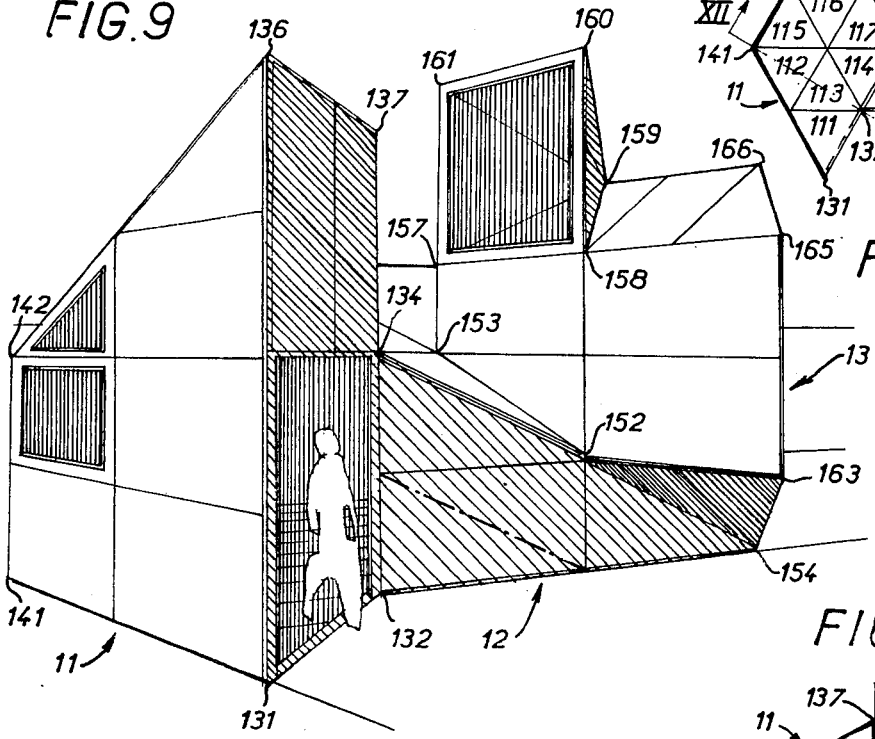
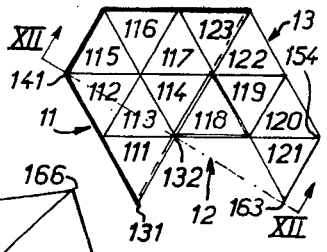
FIG 11
FIG.12
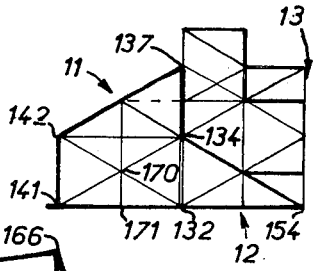
FIG 10
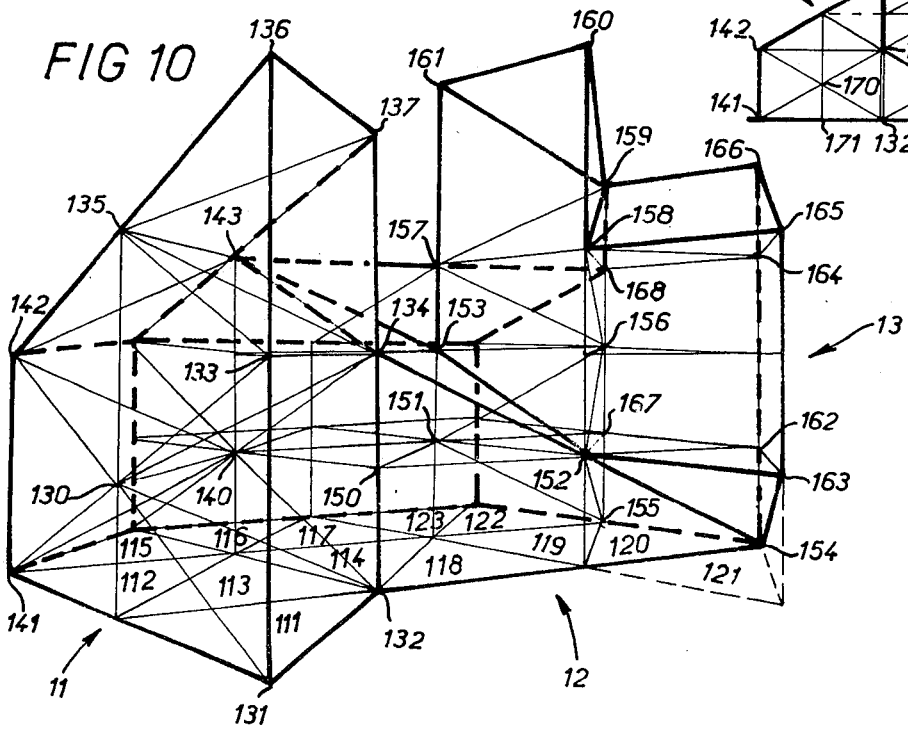

FIG.13
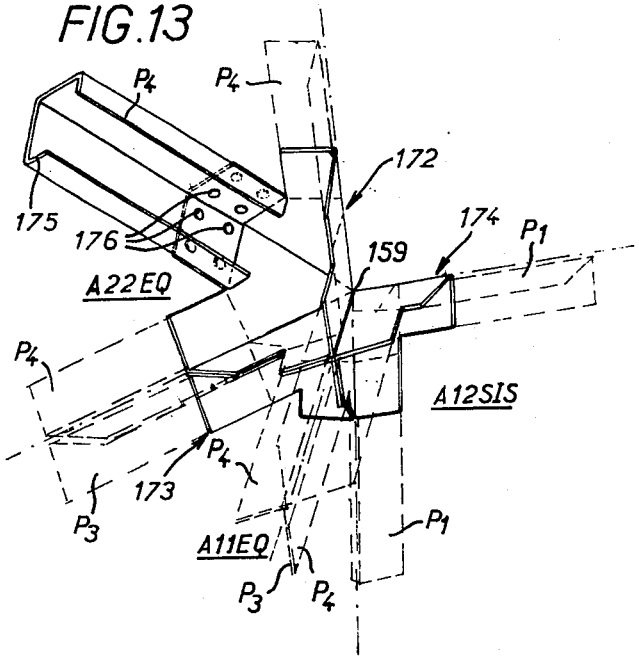
FIG.14
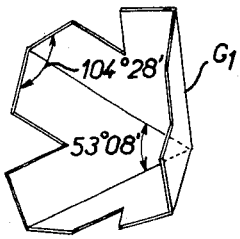
FIG.15
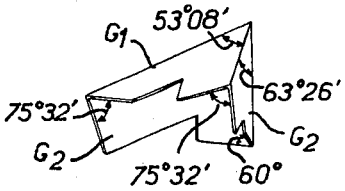
FIG.16
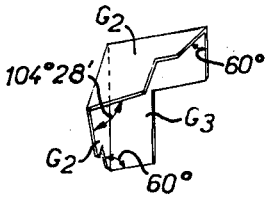
FIG.17
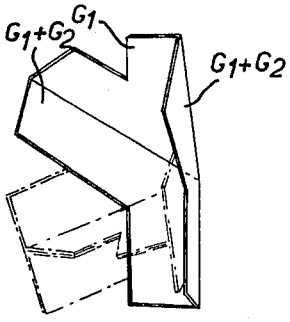
FIG.18
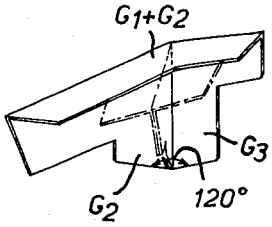
FIG.19
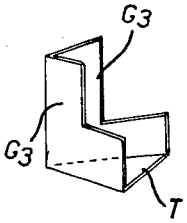
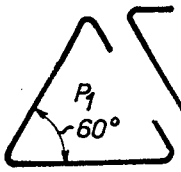
FIG.20
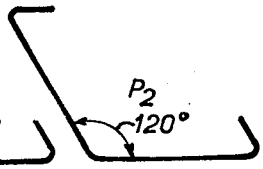
FIG.21
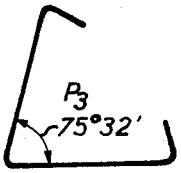
FIG.22
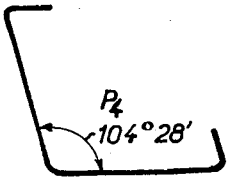
FIG.23

CONSTRUCTION OF BUILDINGS BY ASSEMBLING PREFABRICATED ELEMENTS

The invention relates generally to a technique for the construction of buildings of all kinds which seeks to achieve compatibility between the economic advantages of industrialisation and the greatest possible flexibility in respect of architectural composition.

One aim of the invention is to achieve this result of utilising a small number of standardized types of components suitable for industrial production, thereby permitting substantial economics in the cost price of the buildings without having to restrict the variety of results which can be achieved by assembling the said components.

The invention also seeks to produce components offering flexibility of utilization which permits effective adaptation of the buildings to various sites, climates, and requirements.

Another aim of the invention is to provide a method of building which is readily suitable for various modifications depending on the evolution of users' requirements in time and space.

In order to achieve these various aims, the invention proposes a technique for the construction of buildings utilizing prefabricated elements, which is characterized in that the volumes built are the sum of the elementary volumes resulting from the division of a right prism whose height is a dimension U which is taken as unit, and whose base is an equilateral triangle with sides of the dimension 2U, this division being made through a plane passing through one side of one of the bases and the apex of the other base corresponding to the apex opposite the said side.

This arrangement provides the advantage of making accessible all the well known flexibility of a mesh or equipartition of the equilateral triangle, and this is so in all three dimensions.

The invention would therefore appear to make it possible for the first time to achieve complete exploitation of all the possibilities of the flexibility of the equilateral triangle mesh. It is no less remarkable that the advantage of flexibility of the equilateral triangle mesh is supplemented according to the invention by the considerable simplicity of the relations established between the dimensions. Furthermore, because of this simple relationship the mesh of a square is found in the walls of the constructions.

The basic elements of the invention are advantageously broken down into faces, edges, and apices, thus giving rise to the formation of corresponding components whose number is again greatly limited by simplifications which are rather surprising at first sight, but which arise from the topological properties of the basic elements.

The characteristics and advantages of the invention will moreover be clear from the description given below by way of example and with reference to the accompanying drawings, in which:

FIG. 9 is a view in perspective of part of a building according to the invention;

FIG. 10 is a corresponding diagram;

FIG. 11 is a diagrammatical view of the horizontal projection of the construction;

FIG. 12 is a similar view in vertical projection, in section on the plane XII—XII in FIG. 11;

FIG. 13 is a detail view on a larger scale of one point in the construction shown in the preceding Figures;

FIGS. 14, 15, and 16 show three apex pieces;

FIGS. 17 and 18 show other apex pieces resulting from associations of two of the preceding pieces;

FIG. 19 shows a right-angled apex piece;

FIGS. 20 to 23 show profiles of assembly bars.

DESCRIPTION OF ELEMENTARY VOLUMES

Figure 1:
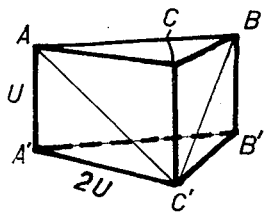
FIG. 1 is a view in perspective of a basic prism.

FIG. 1 is a view in perspective of a right prism whose height is equal to U and which has as its base an equilateral triangle whose sides are equal to 2U. The references A, B, and C designate the apices of one of the bases, and A', B' and C' designate respectively the corresponding apices of the other base.

If this prism is cut through a plane AC', which thus passes through one of the sides (in the present case AB) of one of the bases and through the apex (in the present case C') of the other base, corresponding to the apex (in the present case C) opposite AB, the two elementary volumes of the invention are obtained.

Figure 2:
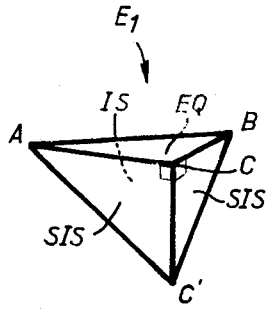
FIGS. 2 and 3 are views in perspective of two elementary volumes according to the invention.

FIG. 2 shows the first of these elementary volumes, that is to say ABCC', which will be given the reference E1. This volume has the following properties:

- the face ABC is the equilateral triangle whose sides are equal to 2U;
- the face ABC' is an isosceles triangle whose base and height are equal to 2U;
- the faces ACC' and BCC' are right-angled triangles whose sides are equal to 2U and U and whose hypotenuse is equal to $U\sqrt{5}$:

The partial faces ACC' and BCC' are the halves of the face ABC'.

The face ABC will be referred to as the "equilateral face" or "EQ"; the face ABC' as the isosceles face or "IS", and the faces ACC' and BCC' will be referred to as the semi-isosceles faces or "SIS."

The dimension 2U will advantageously correspond to the door height adopted for the building.

It will also be noted that the faces SIS form together a dihedral angle of 60°; the faces EQ and IS form together a dihedral angle of 30°; the face IS forms with each of the faces SIS a dihedral angle of 75°32', and the face EQ forms with each of the faces SIS an angle of 90°.

Figure 3:
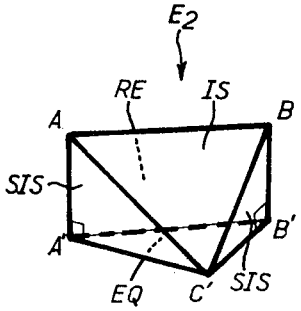

FIG. 3 shows the second elementary volume that is to say ABB'A'C', which will be given the reference E2.

This volume has the following properties:

The face ABB'A' is a rectangle whose sides are equal to 2U and U and will be referred to as the "rectangle face" or "RE";

- the face A'B'C' is a face EQ;
- the face ABC' is a face IS;
- the faces AA'C' and BB'C' are faces SIS.

With regard to the angles, the following values of dihedral angles should be noted in this case:

- 90° between the face EQ on the one hand and each of the faces RE and SIS on the other hand;
- 60° between the face RE and each of the faces SIS and IS;
- 104°28' between the face IS and each of the faces SIS.

ASSOCIATIONS OF ELEMENTARY VOLUMES

Since the invention comprises essentially the formation of volumes constructed by associations of elementary volumes of the types which have just been described above, the modes of these associations may now appropriately be considered.

In a general way, the association of elementary volumes in one and the same constructed volume entails the coincidence of at least two edges of two adjacent elementary volumes.

This general rule having been stated, a description will now be given of some examples of associations of elementary volumes, and in the first instance some examples of primary associations of two elementary volumes which will be given the reference A followed by two numerals corresponding to the numbers of the elementary volume components and by the symbol or symbols of the juxtaposed faces.

The first of these associations, namely A 12 IS, is precisely the right prism shown in FIG. 1.

Figure 4:
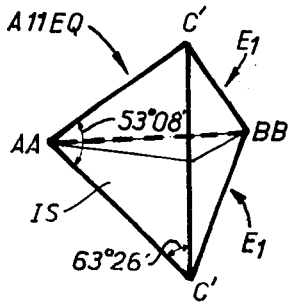
FIGS. 4 to 7 show four examples of primary associations of elementary volumes.
Figure 5:
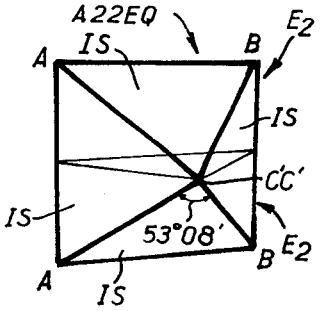

Two other very simple examples are then:

the tetrahedron A 11 EQ shown in FIG. 4, in which the four faces are IS faces and the median sections are EQ faces;

the demi-octahedron A 22 EQ shown in FIG. 5, the base of which is a square whose sides are equal to 2U (that is to say 2 times RE) and four faces IS. The median sections are faces EQ.

Figure 6:
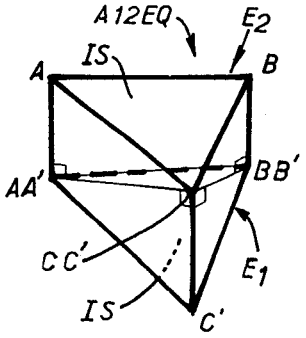

FIG. 6 shows another example of primary association of two elementary volumes, namely the association A 12 EQ, which is a portion of a 60° oblique prism having IS faces as bases together with one face RE and two parallelogram faces resulting from head to tail juxtaposition by the larger side of the right angles of the two IS.

Figure 7:
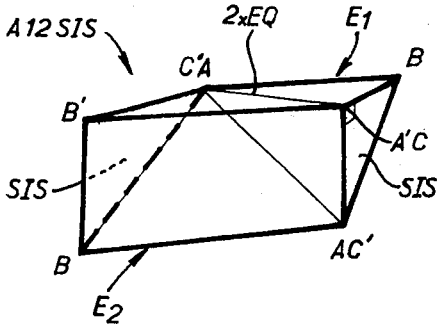

Finally, FIG. 7 shows the association A 12 SIS, which is a 60° oblique prism with bases SIS, with one face RE, one rhombus face (two times EQ), and one parallelogram face resulting from the head to tail juxtaposition of two faces IS by a side of the length $U\sqrt{5}$.

Figure 8:
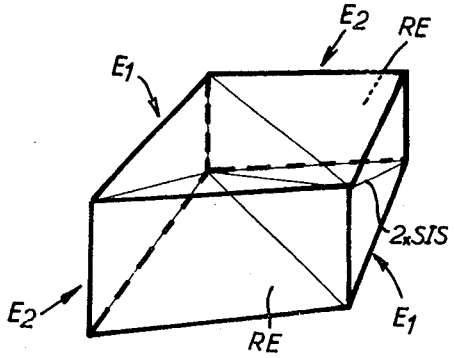
FIG. 8 shows an example of association of four elementary volumes.

As an example of the association of more than two elementary volumes, it will be sufficient to consider the association of four elementary volumes which is illustrated in FIG. 8, this association being the sum of two primary associations A 12 SIS (FIG. 7) juxtaposed by their rhombus faces; this forms a 60° oblique prism having as base the parallelogram resulting from the head to tail association of two SIS and having as faces a pair of faces RE and the pair of parallelogram faces of the two components A 12 SIS.

This association of four elementary volumes shown in FIG. 8 is moreover also the sum of two primary associations A 12 EQ (FIG. 6) juxtaposed by one of their parallelogram faces.

EXAMPLES

There will now be described with reference to FIGS. 9 to 12 an example of experimental production of a building according to the invention. This is an exhibition building intended to house a demonstration stand.

Referring first to FIG. 9, the volume 11 on the left of the Figure forms a reception office, the volume 12 in the middle forms a service and equipment area, and the volume 13 on the right in the Figure forms the commencement of an exhibition area.

The plane projection of the volume 11 (FIG. 11) is the sum of seven equilateral triangles 111 to 117. The projection of the volume 12 comprises the three equilateral triangles 118, 119, and 120, while the projection of the volume 13 comprises the five equilateral triangles 119, 120, 121, 122, and 123.

In the perspective diagram shown in FIG. 10 the references 111 to 123 of these horizontal projection triangles have been shown. This diagram is intended to illustrate the composition of the volumes constructed by the addition of elementary volumes according to the invention.

Starting with the projection triangle 11 we find from bottom to top: one elementary volume E1 having the apex 130 and three primary associations; the first of these is an A22EQ, that is to say the demi-octahedron having as base the vertical square 131-132-133-134 and having the apex 130; the second is an A11EQ, that is to say the tetrahedron having as apices 130,133,134, and 135; the third is a second A22EQ having the apex 135 and the base 133-134-136-137.

Starting from the projection triangle 112 we similarly find a first elementary volume E2 having the apices 130 and 140, then a tetrahedron A11EQ having the apices 130,140,141,142, and a demi-octahedron A22EQ having the base 130-140-143-135 and the apex 142.

Continuing to proceed in this manner, starting from the other projection triangles 113 to 117 the entire volume 11 is formed.

With regard to the volume 12, there is found vertically in line with the projection triangle 118 a right prism A12IS having as bases the triangle 118 and the triangle 150-151-152, and an elementary volume E2 having the apices 134 and 153. Vertically in line with the triangle 119 is found an elementary volume E2 with apices 151,152, and vertically in line with the triangle 120 an elementary volume E1 having the apex 152. The volume 12 constituted in this manner is bounded on the facade by the right-angled triangle 132-134-154 with the vertical side 132-134 whose length is equal to 2U and the horizontal side 132-154 whose length is equal to 4U. With regard to the volume 13, it will be sufficient to consider the portion situated vertically in line with the projection triangles 119, 120, and 121.

Vertically in line with 119 the volume 13 starts from the inclined face (which is a face IS) 151-152-155, which here terminates the volume 12. It comprises in succession a tetrahedron A11EQ having the apices 151,152,155, and 156; a demi-octahedron A22EQ having the base 151-152-157-158 and the apex 156; a tetrahedron A11EQ having the apices 156,157,158,159; and finally, a demioctahedron having the base 157-158-160-161 and the apex 159.

Vertically in line with the projection triangle 120 the volume 13 starts from the inclined (IS) face 154-155-152 and comprises firstly an elementary volume E2 having the base 152-162-167 and the apices 154 and 155.

Vertically in line with the projection triangle 121 a void is left which corresponds to an elementary volume E2, in such a manner as to provide in a cantilever arrangement an elementary volume E1 having the base 152-162-163 and the apex 154.

Vertically in line with the rhombus formed by the sum of the triangles 120 and 121, and starting from the starting elementary volumes which have just been indicated, the volume 13 comprises in succession two pairs of right prisms A12IS capped by a primary association A12SIS having the apices 158,159,166,165,164, and 168.

FIG. 12, which illustrates an example of vertical section of the construction formed in this manner, shows that in the vertical direction the same equilateral triangles are formed as in the horizontal direction. This is a consequence of the properties of the elementary volumes as analyzed above in connection with FIGS. 1 to 8. Thus, for example, in the sectional portion of the volume 11 there are found, bottom to top, the two equilateral half-triangles 141-170-171 and 132-170-171, which are the sections of the two elementary volumes E2 having as bases the projection triangles 112 and 113 and having the apices 130 and 140; there are then found the equilateral triangles 141-142-170, 132-134-170, and so on, which are the median sections of the primary associations A11EQ-A12EQ and so on.

As another remarkable fundamental property it should be noted that all the walls of the construction are composed of whole multiples of a clearly defined elementary surface which is that of the face SIS, namely the right-angled triangle whose shorter side is equal to U and whose larger side is equal to 2U. For example, the above described facade portion of the volume 12, namely the triangular face 132, 134, 154 (FIG. 9) is the sum of four elementary surfaces.

A description will now be given, with reference to FIGS. 13 to 23, of the technique adopted for the experimental construction considered by way of example. This technique comprises the formation in a first stage of a framework materializing certain of the apices and edges of the component elementary volumes, and then in a second stage the fastening on this framework of panels materializing certain of the faces of these volumes.

In order to illustrate the technique of materialization of the apices, the point 159 of the construction considered (FIGS. 9 to 12) has been selected, at which point three apices of adjacent primary associations of the tetrahedral type A11EQ, demi-octahedral type A22EQ, and oblique prism type A12SIS coincide. As can be seen in FIG. 13, each of these apices is materialized by a polyhedral angle adapted to cap it. FIGS. 14 to 16 show respectively and separately each of the three types of apex thus formed.

FIG. 14 thus shows the piece adapted to cap the apex of the demi-octahedron in FIG. 5, this apex being designated C'C' in this Figure. This piece is a quadrihedral angle having four identical faces, each of which faces may be composed of a gusset G1 whose apex angle is equal to that of the face IS, that is to say 53°08', these gussets being connected together by welding. The faces form together, two by two, four dihedral angles of 104°28'.

FIG. 15 shows the piece adapted to cap any of the apices of the tetrahedron shown in FIG. 4. This piece is a trihedral angle whose one face G1 is identical to one of the faces of the preceding piece, while the other two faces G2 have an apex angle of 63°26', the angle at the base of the triangle IS. The faces G2 form together a dihedral angle of 60°, and each of them forms with G1 a dihedral angle of 75°32'.

FIG. 16 shows the piece adapted to cap any of the four base angles A or B of the demi-octahedron (FIG. 5). This is once again a trihedral angle, but it comprises two faces G3 having a right angle at the apex. The faces G2 form together a dihedral angle of 104°∞' and each of them forms with G3 a dihedral angle of 60°.

The three pieces thus formed constitute basic pieces from which all the necessary apices can be formed. Thus, for example, for the purpose of capping the apex CC' in FIG. 6 it is possible to associate the pieces of FIGS. 14 and 15 by placing the face G1 of FIG. 15 against one of the faces of FIG. 14; a new piece is thus obtained which may have the shape shown in FIG. 17, if the two faces lying against one another are eliminated. Similarly, FIG. 18 shows a piece adapted to cap the apex AC' of the oblique prism of FIG. 7, this piece resulting from the association of the pieces shown in FIGS. 15 and 16 by laying one face G2 of each of them against one another and eliminating the pair of faces thus lying against one another. The faces G2 and G3 form together a dihedral angle of 120°, FIG. 19 shows the particular case of a piece intended to permit the connection of a bar to a plane perpendicular to the bar. This piece, which corresponds to one of the apices of the prism shown in FIG. 1, is composed of two faces G3 and one face T having the shape of an equilateral triangle.

The apex pieces which have just been described with reference to FIGS. 14 to 19 are intended to cooperate with connecting bars materializing the edges of elementary volume or combinations of these volumes. These bars are in the form of sections of V-shaped cross-section, the two branches of the V forming together angles of 60° (FIG. 20), 120° (FIG. 21), 75°32' (FIG. 22), and 104°28' (FIG. 23), which are precisely the dihedral angles found in the apex pieces.

The bars P1 and P2 of FIGS. 20 and 21 having the supplementary angles 60° and 120° are used in lengths which are whole multiples of the unit U, while the bars P3 and P4 of FIGS. 22 and 23, which have the supplementary angles 75°32' and 104°28', are used in lengths which are whole multiples of $U \times \sqrt{5}$; this rule, which is one of the remarkable characteristics of the invention, is absolute on the drawing board, whereas in respect of actual length it will be appropriate to provide a reduction corresponding to the space occupied at the apices.

For the purpose of making the various connections, fixing means are provided, for example bolting means, on the one hand for joining apex pieces together and on the other hand for connecting ends of bars and apex pieces. In general the apex pieces are adapted to be connected together by faces laid against one another, and the same is true of connections between apex pieces and branches of sections. For the purpose of bolting together, simple drilled holes are provided both in the faces of the apex pieces and on the end portions of the branches or sections. These drilled holes are advantageously repeated with a pitch of U on the sections P1 and P2 in FIGS. 20 and 21, and with a pitch of $U\sqrt{5}$ on the sections P3 and P4 in FIGS. 22 and 23.

Reverting to FIG. 13, it is seen that at the point 159 considered three apex pieces 172, 173, and 174, which are described with reference to FIGS. 14, 15, and 16 respectively, are joined together two by two by placing a pair of identical faces one against the other. In this particular case each dihedral angle of the assembly thus formed receives a connecting section of equal angle, materilising a corresponding edge of a primary association. As already mentioned, all the connections are here made by bolting and in order not to overload the drawing only the fastening of the section 175 by two groups of four bolts 176 has been indicated.

In the example just described all the apex pieces and all the edges which converge there are materialized. At other points, only some of the apex pieces and edges will be materialized, thus, for example, at the point 142 (FIG. 10) the edges extending towards the points 130,140, and 143 are not materialized, and consequently the piece materializing the apex, since it has to receive only the three remaining bars, will be a trihedron with one face G3 and two faces G1 and G2. Finally, at other points, such as 140, no edge and consequently no apex piece will be materialized.

The complete framework of the construction having been erected and joined together by this technique, a supporting structure is obtained which is adapted to receive panels intended to materialize the desired number of faces, the faces thus materialized being selected at will in accordance with the conditions of utilization of the construction.

Thus, in the example illustrated in FIG. 9 the face 131-141-142-136 is entirely materialized by five panels RE and two panels SIS, one panel of each type being glazed; the face 131-132-137-136 is materialized in the upper half, while a free entrance bay is provided in the lower half.

The plane 151-163-154-155 (FIG. 10) composed of three IS is materialized so as to serve as an inclined display stand in the volume 13 forming the exhibition area. The portion of the volume 12 which extends below this plane is intended to serve to receive projection equipment, the said plane serving as screen.

In connection with the panels it should be noted that, as already observed in the case of the sections, the said dimensions U and 2U are drawing board dimensions which in practice may need to be reduced to take into account the spaces occupied at the junction lines.

The joints themselves will be made by any suitable known techniques.

It should be observed that panels materializing inclined faces, such as the exhibition plane mentioned above, may advantageously be materialized in the form of staircase panels, the slope of a plane of this kind, namely 30°, being precisely the normal staircase slope.

Starting from the fact established in connection with FIGS. 11 and 12, namely that both in horizontal projection and in vertical projection the construction is inscribed in the mesh or equipartition of an equilateral triangle, horizontal planes e.g. (floors) or vertical planes (for example partitions) can be materialized in the form of whole multiples of an elementary panel having the shape of a right-angled triangle which is half the equilateral triangle, with a smaller side equal to U and a larger side equal to $U\sqrt{3}$.

In the example of construction which has just been described the edges of multiple lengths of the unit U are either horizontal or vertical and the horizontal projection is inscribed in the mesh of the equilateral triangle. It is important to observe that this arrangement is not exclusive. It is in fact equally possible to envisage a mode of utilization of the same elements wherein the edges of multiple lengths of the unit are all horizontal, in which case the horizontal projection is inscribed in the mesh of a square. Constructions are thus obtained in which the mesh of the equilateral triangle is found once again in the two vertical planes of the square mesh of the horizontal projection, and in which the side walls have a slope of 60°.

The construction according to the invention permits the formation of large volumes free from pillars, the various framework pieces being in particular extremely suitable for the application of so-called large span techniques (three-dimensional, cross triangular beams, etc.).

The invention is obviously not limited to the embodiments selected and illustrated as examples. Thus, while a construction having a supporting framework has been described, the invention naturally also includes constructions containing supporting panels and even the production by integral moulding of, for example, elementary volumes or associations of elementary volumes adapted to be used in large series, such as for example demi-octahedrons A22EQ (FIG. 5), oblique prisms A12 SIS (FIG. 7), which are for example suitable for forming roofing elements, and so on.

What I claim is:

1. A system of building construction with prefabricated elements, comprising a plurality of juxtaposed elemental volumetric units joined to define a hollow functional building of non-rectangular configuration, said units including at least one irregular tetrahedron and at least one irregular pyramid with a rectangular base, said tetrahedron and said pyramid being mutually determined by a plane passing through one side of an equilateral triangular base of a right prism and the apex of the other base opposite said one side, the height of the right prism being U and the length of the sides of the equilateral triangular bases of the right prism being 2U.

2. A system for building construction according to claim 1, wherein there are doors of a preselected height carried by selected ones of said volumetric units and providing access openings into the interior thereof and twice unit U is selected to be the height of the doors of the building construction.

3. A system of building construction according to claim 1, in which at least some of the edges of the elemental volumetric units are defined by connecting bars each having at least two arms arranged in angular relation to define a V-shaped cross section, the angles defined by the arms of the V-shaped sections defining angles of 60°, 120°, 75°32′ and 104°28′, the lengths of the connecting bars with 60° and 120° angles being whole multiples of the unit U, and the lengths of the connecting bars with 75°32′ and 104°28′ being whole multiples of $U\sqrt{5}$.

4. A system of building construction according to claim 3, wherein an assembly node is provided at the meeting point of at least two of said bars, the assembly node forming a polyhedral angle capping a polyhedral volume defined by at least one said elemental volumetric unit.

5. A system of building construction according to claim 1, wherein said building construction includes walls defined by whole multiples of an elemental panel in the shape of a right triangle whose short side is U and whose long side is 2U.

6. A system of building construction according to claim 1, wherein the construction includes vertical and horizontal planes formed by a whole multiple of an elemental right triangular panel whose short side is U and whose long side is $U\sqrt{3}$.

* * * * *